US011671762B2

(12) United States Patent
Ren et al.

(10) Patent No.: US 11,671,762 B2
(45) Date of Patent: Jun. 6, 2023

(54) SPEAKER

(71) Applicant: AAC Microtech (Changzhou) Co., Ltd., Changzhou (CN)

(72) Inventors: Zhang Ren, Shenzhen (CN); Zhiwei Zhong, Shenzhen (CN); Zhichen Chen, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 31 days.

(21) Appl. No.: 17/563,026

(22) Filed: Dec. 27, 2021

(65) Prior Publication Data

US 2023/0031271 A1 Feb. 2, 2023
US 2023/0031271 A1 Feb. 2, 2023

(30) Foreign Application Priority Data

Aug. 2, 2021 (CN) ..... 202121792703.4

(51) Int. Cl.

| | |
|---|---|
| ***H04R 1/00*** | (2006.01) |
| ***H04R 1/02*** | (2006.01) |
| ***H04R 9/06*** | (2006.01) |
| ***H04R 9/02*** | (2006.01) |
| ***H04R 9/04*** | (2006.01) |

(52) U.S. Cl.
CPC ..... *H04R 9/063* (2013.01); *H04R 9/027* (2013.01); *H04R 9/045* (2013.01); *H04R 2400/11* (2013.01); *H04R 2499/11* (2013.01)

(58) Field of Classification Search
CPC ..... H04R 1/00; H04R 1/02
USPC ..... 381/162, 386
See application file for complete search history.

(56) References Cited

U.S. PATENT DOCUMENTS

2018/0367919 A1* 12/2018 Xiao ..... H04R 31/006

* cited by examiner

*Primary Examiner* — George C Monikang
(74) *Attorney, Agent, or Firm* — W&G Law Group

(57) ABSTRACT

Provided is a speaker, including a frame; a vibration unit fixed to the frame; and a magnetic circuit unit driving the vibration unit to vibrate and produce sound and provided with a magnetic gap. The vibration unit includes a diaphragm, a voice coil, and an elastic support assembly; the diaphragm includes a diaphragm body, a diaphragm fixing portion, a diaphragm supporting portion, and a reinforcing portion; the diaphragm fixing portion has a rectangular structure with round corners, and the diaphragm supporting portion is located at the round corners; the frame is provided with an assembly hole; the vibration unit further includes a fixing ring; and the elastic support assembly includes an elastic member and an auxiliary diaphragm. With this structure, the overall strength and reliability of the speaker are improved.

10 Claims, 8 Drawing Sheets

SPEAKER

TECHNICAL FIELD

The present disclosure relates to the field of electro-acoustic conversion, in particular to a speaker for a portable mobile electronic product.

BACKGROUND

Speakers are widely used in portable mobile electronic products, such as mobile phones, to convert electrical signals into sound signals. The Speakers have high volume and desirable low-frequency sound effects.

In the related art, a speaker includes a frame, a vibration unit fixed to the frame and a magnetic circuit unit driving the vibration unit to vibrate and produce sound. The vibration unit includes a diaphragm fixed to the frame, a voice coil driving the diaphragm to vibrate and produce sound, elastic support assemblies fixed to the frame and directly opposite to and spaced apart from the diaphragm, and a holder fixed to the voice coil. The elastic support assemblies are spaced apart from each other at an outer side of the magnetic circuit unit. Along a vibrating direction of the diaphragm, one end of the holder is fixed to the diaphragm, and another end of the holder is fixed to the elastic support assemblies. The elastic support assemblies each include an elastic member and an auxiliary diaphragm attached to and fixed to a side of the elastic member away from the diaphragm.

The elastic member and the auxiliary diaphragm are fixed by gluing, and the elastic support assemblies are directly attached to and fixed to the frame, resulting in low overall strength of the speaker. Once the speaker is dropped, the elastic member is prone to be separated from the auxiliary diaphragm, and the elastic support assemblies are prone to be separated from the frame. Therefore, the speaker with such a structure has low reliability.

Therefore, it needs to provide a speaker to solve the above technical problem.

SUMMARY

An objective of the present disclosure is to provide a speaker with high overall strength and reliability.

An embodiment of the present disclosure provides a speaker, including: a frame; a vibration unit fixed to the frame; and a magnetic circuit unit driving the vibration unit to vibrate and produce sound and provided with a magnetic gap. The vibration unit includes a diaphragm fixed to the frame, a voice coil inserted in the magnetic gap to drive the diaphragm to vibrate and produce sound, and an elastic support assembly opposite to and spaced apart from the diaphragm; and the elastic support assembly surrounds an outer side of the magnetic circuit unit and is spaced apart from the magnetic circuit unit; the diaphragm includes a diaphragm body for vibrating and producing sound, a diaphragm fixing portion bending and extending from an outer peripheral side of the diaphragm body toward an inner side of the frame, a diaphragm supporting portion extending from the diaphragm fixing portion toward the elastic support assembly along the inner side of the frame, and a reinforcing portion protruding and extending from the diaphragm supporting portion toward the frame; the diaphragm fixing portion and the diaphragm supporting portion are attached to and fixed to the inner side of the frame; the diaphragm fixing portion has a rectangular structure with round corners, and the diaphragm supporting portion is located at the round corners; the frame is provided with an assembly hole that penetrates through the frame and matches the reinforcing portion, and the reinforcing portion is inserted into the assembly hole to be fixed to and connected to the frame; the vibration unit further includes a fixing ring configured to fix the elastic support assembly to the frame; and the fixing ring surrounds the magnetic circuit unit; and the elastic support assembly includes an elastic member and an auxiliary diaphragm provided on a side of the elastic member away from the diaphragm; a side of the elastic member close to the frame and a side of the auxiliary diaphragm close to the frame are attached to two opposite sides of the fixing ring; and the diaphragm supporting portion is fixed to a side of elastic members away from the fixing ring.

As an improvement, the frame is further provided with a frame clamping portion bending and extending from a periphery of the assembly hole toward the inner side of the frame; the reinforcing portion is recessed to form an avoiding groove that matches the frame clamping portion; and the frame clamping portion is inserted in the avoiding groove.

As an improvement, the diaphragm further includes a diaphragm extension portion extending from an end of the diaphragm fixing portion away from the elastic support assembly along the inner side of the frame in a direction away from the elastic support assembly; and the diaphragm extension portion is attached to and fixed to the inner side of the frame.

As an improvement, the vibration unit further includes a holder fixed to the diaphragm; the holder includes a holder body having a ring shape, a first holder fixing portion bending and extending from an inner peripheral side of the holder body toward the voice coil, and a second holder fixing portion bending and extending from an outer peripheral side of the holder body toward the elastic support assembly; the holder body is fixed to the diaphragm body; the first holder fixing portion is fixed to and connected to the voice coil; and the second holder fixing portion is fixed to and connected to the elastic support assembly.

As an improvement, the fixing ring includes a fixing ring body having a ring shape, and a fixing ring fixing portion bending and extending from an inner peripheral side of the fixing ring body in a direction away from the diaphragm; and an outer peripheral side of the fixing ring body is fixed to the frame.

As an improvement, the auxiliary diaphragm includes an auxiliary diaphragm suspension, a first auxiliary diaphragm fixing portion bending and extending from an inner side of the auxiliary diaphragm suspension toward the magnetic circuit unit, a first auxiliary diaphragm extension portion extending from the first auxiliary diaphragm fixing portion toward the diaphragm, a second auxiliary diaphragm fixing portion bending and extending from an outer side of the auxiliary diaphragm suspension toward the frame, and a second auxiliary diaphragm extension portion extending from the second auxiliary diaphragm fixing portion toward the diaphragm; the first auxiliary diaphragm fixing portion is fixed to the second holder fixing portion, and the first auxiliary diaphragm extension portion is attached to and fixed to a side of the second holder fixing portion close to the frame; and the second auxiliary diaphragm fixing portion is fixed to a side of the fixing ring fixing portion away from the diaphragm; an inner side of the second auxiliary diaphragm extension portion is attached to and fixed to an outer side of the fixing ring fixing portion; and a side of the second auxiliary diaphragm extension portion close to the diaphragm abuts against and is fixed to a side of the fixing ring body away from the diaphragm.

As an improvement, the elastic member includes a first fixing arm fixed to the fixing ring body, a second fixing arm fixed to the holder, and an elastic arm connecting the first fixing arm and the second fixing arm; the diaphragm supporting portion is fixed to a side of first fixing arm close to the diaphragm; the second holder fixing portion is provided with a holder hole that penetrates through the second holder fixing portion; and the second fixing arm passes through the holder hole to be fixed to the first holder fixing portion.

As an improvement, the diaphragm body includes a first suspension having a ring shape, a second suspension having a ring shape and a vibrating portion having a ring shape; the first suspension surrounds the second suspension and is spaced apart from the second suspension; and an outer peripheral side of the vibrating portion is fixed to a side of the first suspension close to the second suspension, and an inner peripheral side of the vibrating portion is fixed to a side of the second suspension close to the first suspension; the diaphragm fixing portion bends and extends from an outer peripheral side of the first suspension; and the holder body is fixed to a side of the vibrating portion close to the magnetic circuit unit.

As an improvement, the fixing ring is a metal ring.

As an improvement, the frame includes a bottom wall, a first side wall bending and extending from a peripheral side of the bottom wall, and a second side wall stacked to and fixed to an end of the first side wall away from the bottom wall; and the assembly hole is formed in the second side wall; and the magnetic circuit unit is fixed to the bottom wall; and the diaphragm fixing portion and the diaphragm supporting portion are fixed to the second side wall.

Compared with the related art, in the present disclosure, a fixing ring is sandwiched in the elastic support assemblies to connect the elastic member and the auxiliary diaphragm into a whole. With this structure, the elastic support assemblies of the speaker reduce the vibration amplitude of the voice coil, and reduce the vibration of the vibration unit and thus reduce the heat caused by the vibration, thereby improving the reliability of the speaker. The diaphragm is provided with a diaphragm fixing portion extending along the outer peripheral side of the diaphragm body and diaphragm supporting portions. The diaphragm fixing portion and the diaphragm supporting portions are fixed to the frame, and the diaphragm supporting portions are fixed to the elastic members. The diaphragm fixes the elastic support assemblies and the fixing ring to the frame through the diaphragm supporting portions. With this simple structure, the elastic support assemblies and the fixing ring can easily be fixed to the frame. There is no need to separately design a structural support feature on the fixing ring or the frame to add a part or process step, which simplifies the assembly process of the speaker; in addition, the elastic support assemblies, the fixing ring, the diaphragm and the frame of the speaker form a firm overall structure. Moreover, in the present disclosure, the frame is provided with assembly holes matching the reinforcing portions, and the reinforcing portions are inserted into the assembly holes to be fixed to and connected to the frame. The structure is easy to assemble and has high fixing strength, thereby improving the overall strength and reliability of the speaker.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

Figure 1:
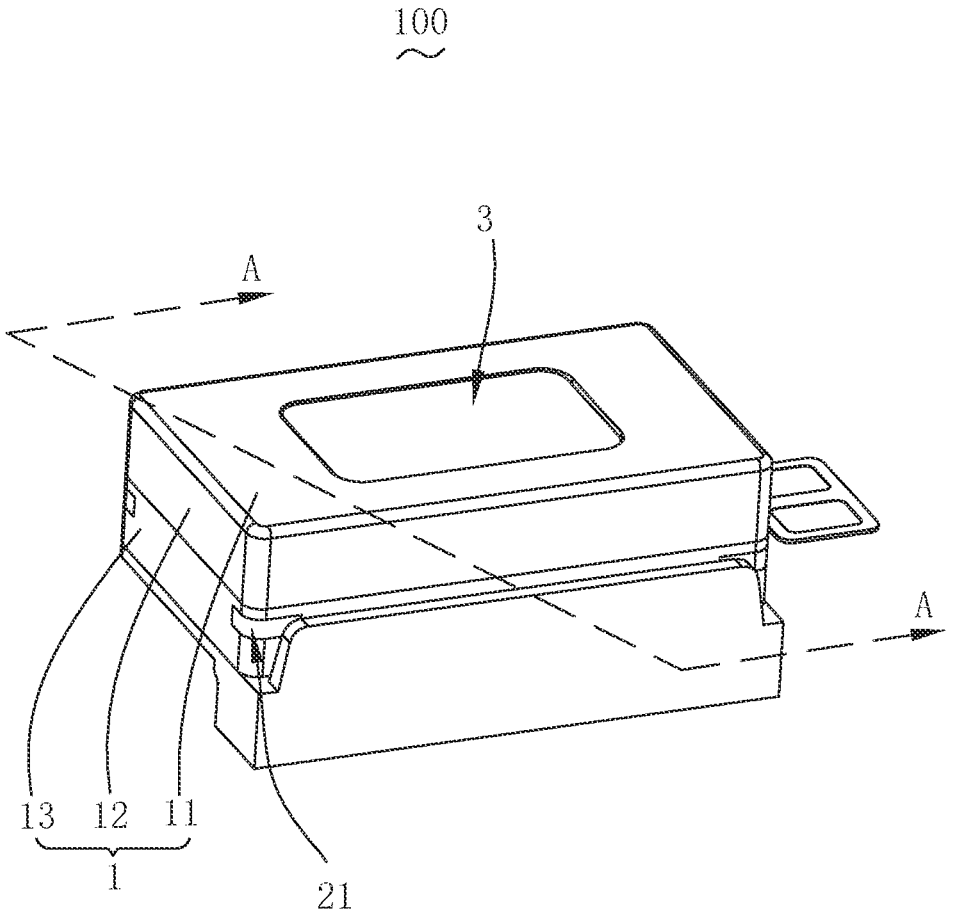
FIG. 1 is a three-dimensional view illustrating a structure of a speaker according to an embodiment of the present disclosure.
Figure 2:
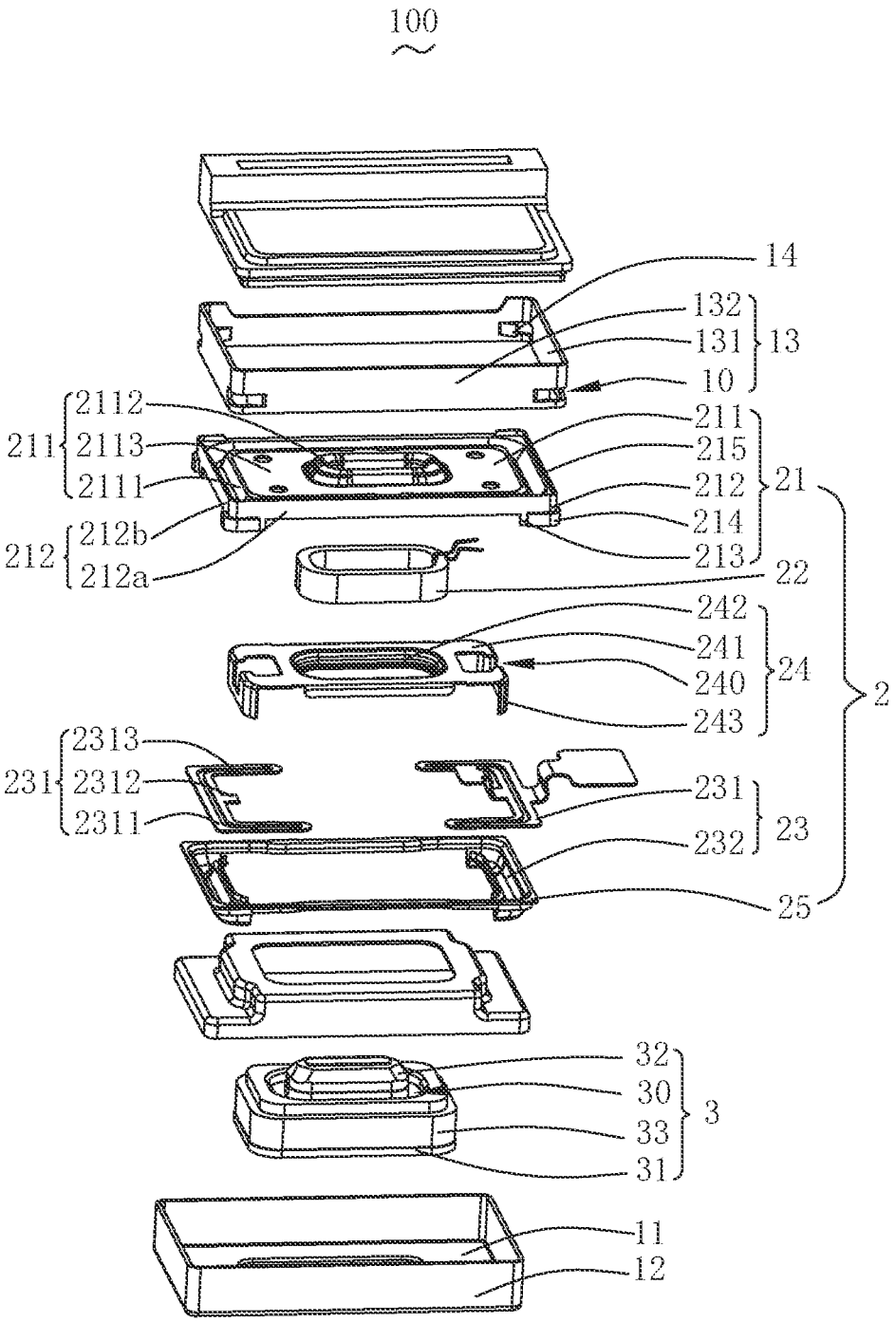
FIG. 2 is a three-dimensional exploded view illustrating a structure of a speaker according to an embodiment of the present disclosure
Figure 3:
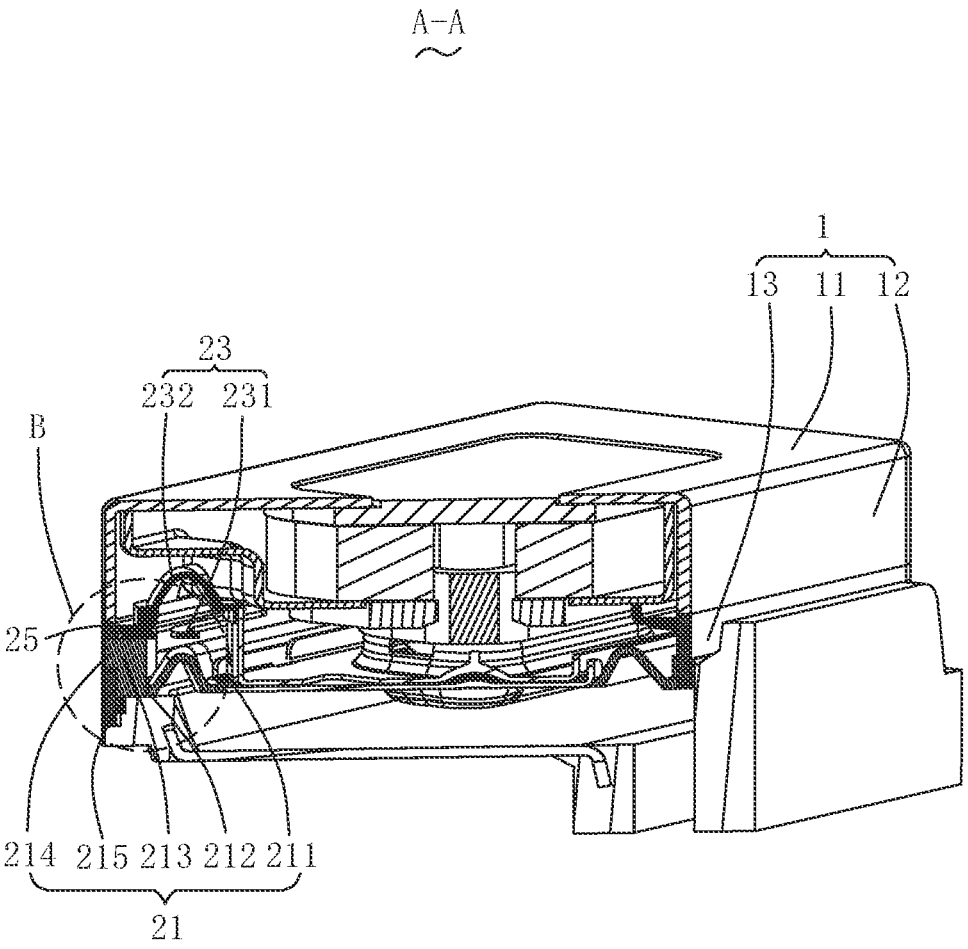
FIG. 3 is a sectional view taken along line shown A-A in FIG. 1.
Figure 4:
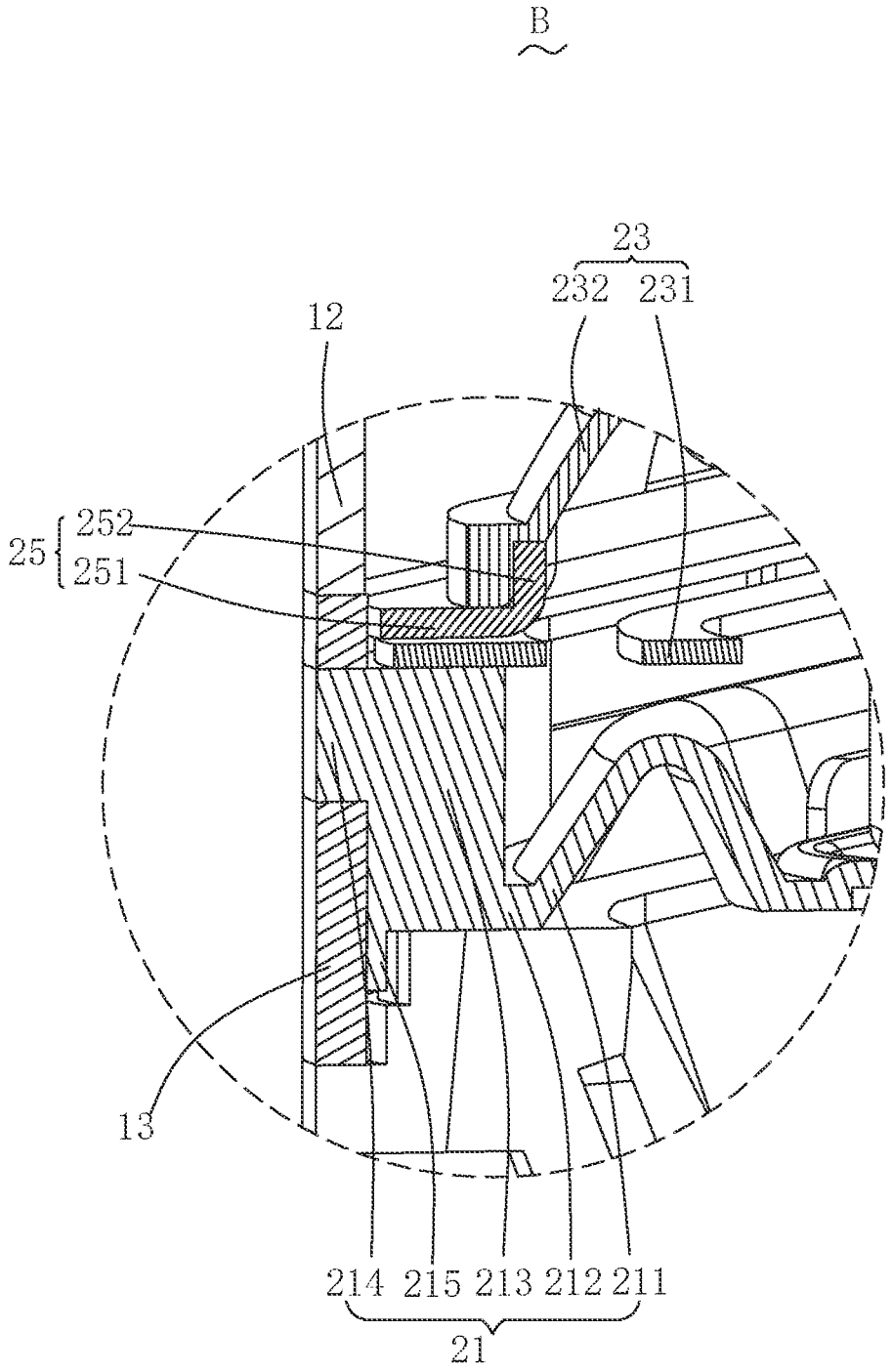
FIG. 4 is an enlarged view of B shown in FIG. 3.
Figure 5:
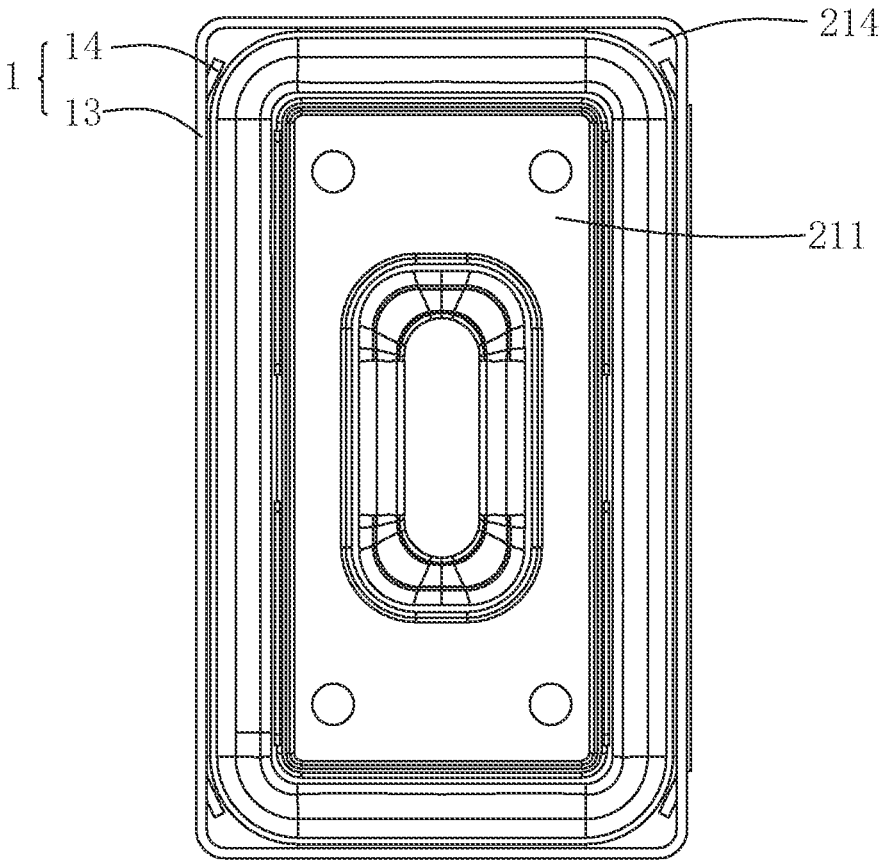
FIG. 5 is a three-dimensional view illustrating a structure of a second side wall and a diaphragm of a speaker after assembly according to an embodiment of the present disclosure.
Figure 6:
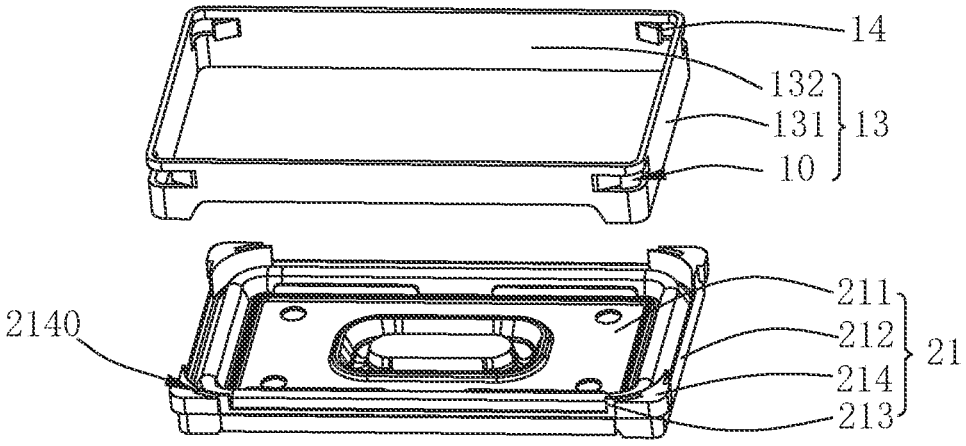
FIG. 6 is a three-dimensional exploded view of the structure shown in FIG. 5.
Figure 7:
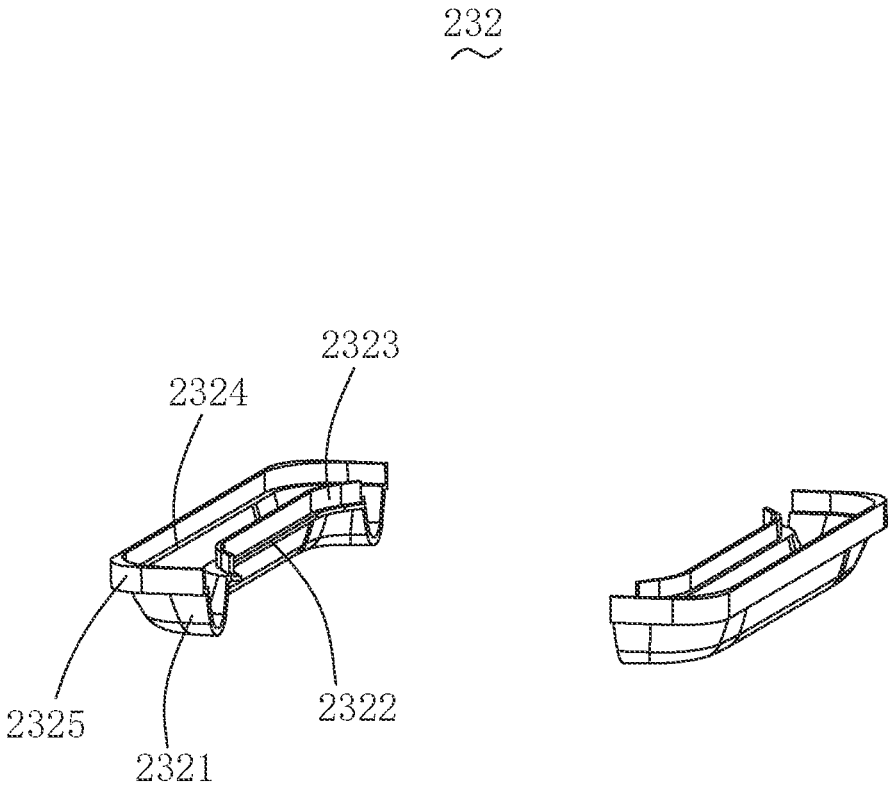
FIG. 7 is a three-dimensional view illustrating a structure of auxiliary diaphragms of the speaker according to an embodiment of the present disclosure.
Figure 8:
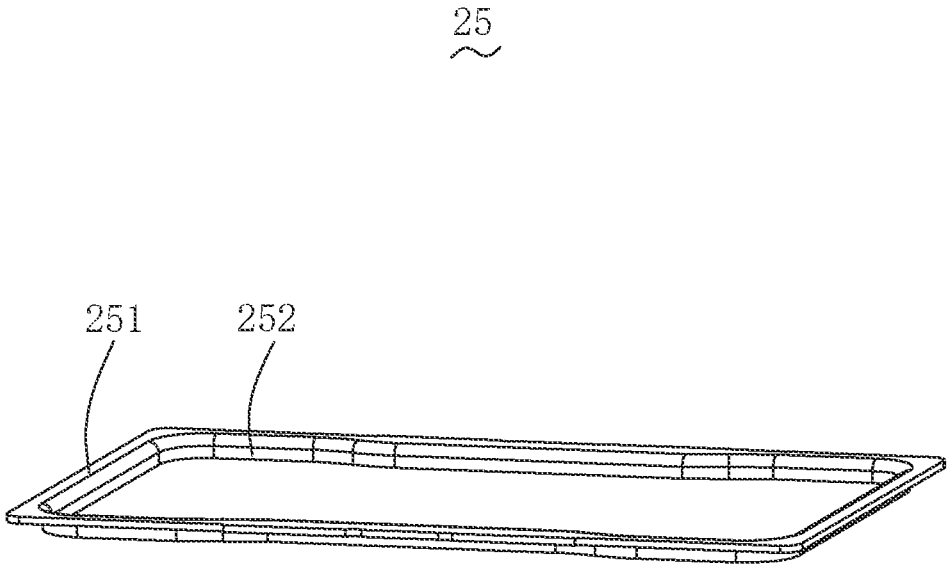
FIG. 8 is a three-dimensional view illustrating a structure of a fixing ring of a speaker according to an embodiment of the present disclosure.

Referring to FIG. 1 to FIG. 8, an embodiment of the present disclosure provides a speaker 100.

The speaker 100 includes a frame 1, a vibration unit 2 fixed to the frame 1, and a magnetic circuit unit 3 driving the vibration unit 2 to vibrate and produce sound. The magnetic circuit unit 3 is provided with a magnetic gap 30.

The frame 1 is ring-shaped.

In this implementation, the frame 1 includes a bottom wall 11, a first side wall 12 bending and extending from a peripheral side of the bottom wall 11 and a second side wall 13 stacked to and fixed to an end of the first side wall 12 away from the bottom wall 11. The magnetic circuit unit 3 is fixed to the bottom wall 11. The structure of the frame 1, which includes separated parts, facilitates the assembly and manufacture of the speaker 100.

The vibration unit 2 includes a diaphragm 21 fixed to the frame 1, a voice coil 22 inserted in the magnetic gap 30 to drive the diaphragm 21 to vibrate and produce sound, elastic support assemblies 23 opposite to and spaced apart from the diaphragm 21 and connected to the voice coil 22, a holder 24 fixed to the diaphragm 21, and a fixing ring 25 configured to fix the elastic support assemblies 23 to the frame 1. The fixing ring 25 surrounds the magnetic circuit unit 3.

In this implementation, the diaphragm 21 includes a diaphragm body 211, a diaphragm fixing portion 212, diaphragm supporting portions 213 and reinforcing portions 214.

The diaphragm body 211 is configured to vibrate and produce sound. The diaphragm body 211 includes a ring-shaped first suspension 2111, a ring-shaped second suspension 2112 and a ring-shaped vibrating portion 2113.

The first suspension 2111 surrounds the second suspension 2112 and is spaced apart from the second suspension 2112.

An outer peripheral side of the vibrating portion 2113 is fixed to a side of the first suspension 2111 close to the second suspension 2112. An inner peripheral side of the vibrating portion 2113 is fixed to a side of the second suspension 2112 close to the first suspension 2111.

The diaphragm fixing portion 212 bends and extends from an outer peripheral side of the diaphragm body 211 toward an inner side of the frame 1. Specifically, the diaphragm fixing portion 212 bends and extends from the outer peripheral side of the diaphragm body 211 along an inner side of the second side wall 13. The diaphragm fixing portion 212 bends and extends from an outer peripheral side of the first suspension 2111. The diaphragm fixing portion 212 is attached to and fixed to the inner side of the frame 1.

In this implementation, the diaphragm fixing portion 212 extends from the outer peripheral side of the diaphragm body 211 along the inner side of the frame 1 in a direction away from the elastic support assemblies 23. With this structure, the bonding area of the diaphragm fixing portion 212 and the frame 1 is increased to achieve firm fixing, thereby improving the overall strength and reliability of the speaker 100.

The diaphragm supporting portions 213 extend from the diaphragm fixing portion 212 toward the elastic support assemblies 23 along the inner side of the frame 1. The diaphragm supporting portions 213 are fixed to the inner side of the frame 1. Specifically, the diaphragm supporting portions 213 are attached to and fixed to the second side wall 13. The diaphragm supporting portions 213 are configured to fix the elastic support assemblies 23 to the frame 1.

In this implementation, the diaphragm fixing portion 212 and the diaphragm supporting portions 213 are attached to and fixed to the inner side of the second side wall 13, thereby facilitating the manufacture and assembly of the speaker 100.

In am embodiment, the diaphragm fixing portion 212 has a rectangular structure with round corners 212*b*. The diaphragm fixing portion 212 includes four straight edges 212*a* and four round corners 212*b* respectively connecting two adjacent straight edges 212*a* of the four straight edges 212*a*. The diaphragm supporting portions 213 are respectively located at the round corners 212*b*. In other words, the diaphragm supporting portions 213 are formed by extending from the round corners 212*b* of the diaphragm fixing portion 212. With this structure, the space between the diaphragm 21 and the frame 1 at the round corners 212*b* is fully utilized, so that the diaphragm supporting portions 213 can better support the elastic support assemblies 23, and the bonding area with the frame 1 can be increased, thereby improving the overall strength and reliability of the speaker 100.

In this implementation, the frame 1 is provided with assembly holes 10 that match the reinforcing portions 214. Specifically, the assembly holes 10 are provided in the second side wall 13. The reinforcing portions 214 are inserted into the assembly holes 10 and fixed to and connected to the frame 1. The assembly holes 10 and the reinforcing portions 214 form a tenon-and-mortise structure, which is firm and easy to assemble, thereby improving the overall strength and reliability of the speaker 100.

In this implementation, the frame 1 has a rectangular structure. The frame 1 is further provided with frame clamping portions 14 bending and extending from peripheries of the assembly holes 10 toward the inner side of the frame 1. The reinforcing portions 214 are recessed to form avoiding grooves 2140 that match the frame clamping portions. The frame clamping portions 14 are inserted in the avoiding grooves 2140. This structure facilitates the fixing and mounting of the reinforcing portions 214 with the assembly holes 10. The frame clamping portions 14 and the avoiding grooves 2140 form a tenon-and-mortise structure, which is firm and easy to assemble, and saves the internal space of the frame 1, thereby improving the overall strength and reliability of the speaker 100.

In order to strengthen the fixed connection between the diaphragm 21 and the frame 1, in this implementation, the diaphragm 21 further includes a diaphragm extension portion 215 extending from an end of the diaphragm fixing portion 212 away from the elastic support assemblies 23 along the inner side of the frame 1 in a direction away from the elastic support assemblies 23. The diaphragm extension portion 215 is attached to and fixed to the inner side of the frame 1. With this structure, the bonding area of the diaphragm 21 and the frame 1 is increased, thereby improving the overall strength and reliability of the speaker 100.

The voice coil 22 is inserted and suspended in the magnetic gap 30 to drive the diaphragm 21 to produce sound.

The elastic support assemblies 23 are provided between a bottom plate of the frame 1 and the diaphragm 21. Specifically, the elastic support assemblies 23 surround an outer side of the magnetic circuit unit 3 and are spaced apart from the magnetic circuit unit 3.

Specifically, the elastic support assemblies 23 each include an elastic member 231 and an auxiliary diaphragm 232 provided on a side of the elastic member 231 away from the diaphragm 21. The elastic support assemblies 23 strengthen the vibration effect of the diaphragm 21 so as to improve the acoustic performance of the speaker 100, and also balance the swing of the vibration unit 2 so as to improve the stability of the speaker 100.

The elastic member 231 includes a first fixing arm 2311 fixed to a fixing ring body 251, a second fixing arm 2312 fixed to the holder 24, and an elastic arm 2313 connecting the first fixing arm 2311 and the second fixing arm 2312.

The diaphragm supporting portions 213 are fixed to sides of elastic members 231 away from the auxiliary diaphragm 232. The diaphragm supporting portions 213 are fixed to sides of first fixing arms 2311 close to the diaphragm 21. With this simple structure, the diaphragm supporting portions 213 easily fix the elastic support assemblies 23 and the fixing ring to the frame 1 without needing to separately design a structural support feature on the fixing ring or the frame to add a part or process step, thereby simplifying the assembly process of the speaker 100; in addition, the elastic support assemblies 23, the fixing ring 25, the diaphragm 21 and the frame 1 of the speaker 100 form a firm overall structure, which improves the overall strength and reliability of the speaker 100.

In this implementation, the elastic member 231 is a flexible printed circuit (FPC) electrically connected to the voice coil 22. The elastic member 231 also serves to provide an electrical signal for a lead wire of the voice coil 22, thereby avoiding the use of a lead wire structure to introduce the electrical signal to the voice coil 22. Therefore, a risk of wire breakage is avoided, and the reliability of the speaker 100 is improved.

The auxiliary diaphragm 232 includes an auxiliary diaphragm suspension 2321, a first auxiliary diaphragm fixing portion 2322 bending and extending from an inner side of the auxiliary diaphragm suspension 2321 toward the magnetic circuit unit 3, a first auxiliary diaphragm extension portion 2323 extending from the first auxiliary diaphragm fixing portion 2322 toward the diaphragm 21, a second auxiliary diaphragm fixing portion 2324 bending and extending from an outer side of the auxiliary diaphragm suspension 2321 toward the frame 1, and a second auxiliary diaphragm extension portion 2325 extending from the second auxiliary diaphragm fixing portion 2324 toward the diaphragm 21.

In this implementation, the fixing ring 25 includes a ring-shaped fixing ring body 251 and a fixing ring fixing portion 252 bending and extending from an inner peripheral side of the fixing ring body 251 in a direction away from the diaphragm 21.

An outer peripheral side of the fixing ring body 251 is fixed to the frame 1. This structure facilitates the fixing ring 25 to fix the elastic support assemblies 23 to the frame 1, thereby improving the reliability of the speaker 100.

A side of the elastic member 231 close to the frame 1 and a side of the auxiliary diaphragm 232 close to the frame 1 are attached to two opposite sides of the fixing ring 25. A side of the elastic member 231 away from the frame 1 and a side of the auxiliary diaphragm 232 away from the frame 1 are spaced apart from each other and are connected to the voice coil 22. In other words, the fixing ring 25 is sandwiched between an outer side of the elastic member 231 and an outer side of the auxiliary diaphragm 232. A side of the holder 24 away from the magnetic circuit unit 3 is sandwiched between an inner side of the elastic member 231 and an inner side of the auxiliary diaphragm 232.

Specifically, one side of the elastic member 231 is fixed to a side of the fixing ring body 251 close to the diaphragm 21, and another side of the elastic member 231 is fixed to the holder 24 and is spaced apart from the auxiliary diaphragm 232. The first auxiliary diaphragm fixing portion 2322 is fixed to an end of the holder 24 away from the diaphragm 21, and the first auxiliary diaphragm extension portion 2323 is attached to and fixed to a side of the holder 24 close to the frame 1. The second auxiliary diaphragm fixing portion 2324 is fixed to a side of the fixing ring fixing portion 252 away from the diaphragm 21. An inner side of the second auxiliary diaphragm extension portion 2325 is attached to and fixed to an outer side of the fixing ring fixing portion 252. A side of the second auxiliary diaphragm extension portion 2325 close to the diaphragm 21 abuts against and is fixed to a side of the fixing ring body 251 away from the diaphragm 21. The diaphragm supporting portions 213 are fixed to sides of elastic members 231 away from the fixing ring 25. The fixing ring 25 makes the elastic member 231 and the auxiliary diaphragm 232 fixed and formed into an integral structure. With this structure, the elastic support assemblies 23 of the speaker 100 reduce the vibration amplitude of the voice coil 22, and reduce the vibration of the vibration unit 2 and thus reduce the heat caused by the vibration, thereby improving the reliability of the speaker 100; in addition, it facilitates the separating of the elastic member 231 and the auxiliary diaphragm 232, such that the elastic member 231 and the auxiliary diaphragm 232 can play their respective roles, thereby improving the reliability of the speaker 100.

One end of the holder 24 extends into the magnetic gap 30 and is fixed to and connected to the voice coil 22, and another end of the holder 24 extends toward the elastic support assemblies 23 and is fixed to and connected to the elastic support assemblies 23. Specifically, the holder 24 includes a ring-shaped holder body 241, a first holder fixing portion 242 bending and extending from an inner peripheral side of the holder body 241 toward the voice coil 22, and second holder fixing portions 243 bending and extending from an outer peripheral side of the holder body 241 toward the elastic support assemblies 23.

The holder body 241 is fixed to the diaphragm body 211. Specifically, the holder body 241 is fixed to a side of the vibrating portion 2113 close to the magnetic circuit unit 3. The first holder fixing portion 242 is fixed to and connected to the voice coil 22.

The first auxiliary diaphragm fixing portion 2322 is fixed to a corresponding second holder fixing portion 243, and the first auxiliary diaphragm extension portion 2323 is fixed to a side of the second holder fixing portion 243 toward the frame 1.

In this implementation, the second holder fixing portions 243 each are provided with a holder hole 240. The second fixing arm 2312 passes through the holder hole 240 to be fixed to the second holder fixing portion 243. With this structure, the height of the elastic member 231 fixed to the holder 24 is adjustable, such that the elastic member 231 maintains a distance from the auxiliary diaphragm 232, thereby improving the reliability of the speaker 100.

Along a vibrating direction of the diaphragm 21, one end of the holder 24 is fixed to the diaphragm 21, and another end of the holder 24 is fixed to the elastic support assemblies 23.

In this implementation, the fixing ring 25 is a metal ring. This structure facilitates the heat dissipation of the elastic support assemblies 23, and facilitates the processing and assembly of the speaker 100.

The magnetic circuit unit 3 includes a yoke 31 fixed to the bottom wall 11, a main magnet 32 fixed to the yoke 31, and an auxiliary magnet 33 surrounding the main magnet 32 and spaced apart from the main magnet to form the magnetic gap 30.

Compared with the related art, in the present disclosure, a fixing ring is sandwiched in the elastic support assemblies to connect the elastic member and the auxiliary diaphragm into a whole. With this structure, the elastic support assemblies of the speaker reduce the vibration amplitude of the voice coil, and reduce the vibration of the vibration unit and thus reduce the heat caused by the vibration, thereby improving the reliability of the speaker. The diaphragm is provided with a diaphragm fixing portion extending along the outer peripheral side of the diaphragm body and diaphragm supporting portions. The diaphragm fixing portion and the diaphragm supporting portions are fixed to the frame, and the diaphragm supporting portions are fixed to the elastic members. The diaphragm fixes the elastic support assemblies and the fixing ring to the frame through the diaphragm supporting portions. With this simple structure, the elastic support assemblies and the fixing ring can easily be fixed to the frame. There is no need to separately design a structural support feature on the fixing ring or the frame to add a part or process step, which simplifies the assembly process of the speaker; in addition, the elastic support assemblies, the fixing ring, the diaphragm and the frame of the speaker form a firm overall structure. Moreover, in the present disclosure, the frame is provided with assembly holes matching the reinforcing portions, and the reinforcing portions are inserted into the assembly holes to be fixed to and connected to the frame. The structure is easy to assemble and has high fixing strength, thereby improving the overall strength and reliability of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame;

a vibration unit fixed to the frame; and a magnetic circuit unit driving the vibration unit to vibrate and produce sound and provided with a magnetic gap, wherein the vibration unit comprises a diaphragm fixed to the frame, a voice coil inserted in the magnetic gap to drive the diaphragm to vibrate and produce sound, and an elastic support assembly opposite to and spaced apart from the diaphragm; and the elastic support assembly surrounds an outer side of the magnetic circuit unit and is spaced apart from the magnetic circuit unit;

the diaphragm comprises a diaphragm body for vibrating and producing sound, a diaphragm fixing portion bending and extending from an outer peripheral side of the diaphragm body toward an inner side of the frame, a diaphragm supporting portion extending from the diaphragm fixing portion toward the elastic support assembly along the inner side of the frame, and a reinforcing portion protruding and extending from the diaphragm supporting portion toward the frame; the diaphragm fixing portion and the diaphragm supporting portion are attached to and fixed to the inner side of the frame; the diaphragm fixing portion has a rectangular structure with round corners, and the diaphragm supporting portion is located at the round corners; the frame is provided with an assembly hole that penetrates through the frame and matches the reinforcing portion, and the reinforcing portion is inserted into the assembly hole to be fixed to and connected to the frame; the vibration unit further comprises a fixing ring configured to fix the elastic support assembly to the frame; and the fixing ring surrounds the magnetic circuit unit; and the elastic support assembly comprises an elastic member and an auxiliary diaphragm provided on a side of the elastic member away from the diaphragm; a side of the elastic member close to the frame and a side of the auxiliary diaphragm close to the frame are attached to two opposite sides of the fixing ring; and the diaphragm supporting portion is fixed to a side of elastic members away from the fixing ring.

2. The speaker as described in claim 1, wherein the frame is further provided with a frame clamping portion bending and extending from a periphery of the assembly hole toward the inner side of the frame; the reinforcing portion is recessed to form an avoiding groove that matches the frame clamping portion; and the frame clamping portion is inserted in the avoiding groove.

3. The speaker as described in claim 1, wherein the diaphragm further comprises a diaphragm extension portion extending from an end of the diaphragm fixing portion away from the elastic support assembly along the inner side of the frame in a direction away from the elastic support assembly; and the diaphragm extension portion is attached to and fixed to the inner side of the frame.

4. The speaker as described in claim 1, wherein the vibration unit further comprises a holder fixed to the diaphragm; the holder comprises a holder body having a ring shape, a first holder fixing portion bending and extending from an inner peripheral side of the holder body toward the voice coil, and a second holder fixing portion bending and extending from an outer peripheral side of the holder body toward the elastic support assembly; the holder body is fixed to the diaphragm body; the first holder fixing portion is fixed to and connected to the voice coil; and the second holder fixing portion is fixed to and connected to the elastic support assembly.

5. The speaker as described in claim 4, wherein the fixing ring comprises a fixing ring body having a ring shape, and a fixing ring fixing portion bending and extending from an inner peripheral side of the fixing ring body in a direction away from the diaphragm; and an outer peripheral side of the fixing ring body is fixed to the frame.

6. The speaker as described in claim 5, wherein the auxiliary diaphragm comprises an auxiliary diaphragm suspension, a first auxiliary diaphragm fixing portion bending and extending from an inner side of the auxiliary diaphragm suspension toward the magnetic circuit unit, a first auxiliary diaphragm extension portion extending from the first auxiliary diaphragm fixing portion toward the diaphragm, a second auxiliary diaphragm fixing portion bending and extending from an outer side of the auxiliary diaphragm suspension toward the frame, and a second auxiliary diaphragm extension portion extending from the second auxiliary diaphragm fixing portion toward the diaphragm;

the first auxiliary diaphragm fixing portion is fixed to the second holder fixing portion, and the first auxiliary diaphragm extension portion is attached to and fixed to a side of the second holder fixing portion close to the frame; and the second auxiliary diaphragm fixing portion is fixed to a side of the fixing ring fixing portion away from the diaphragm; an inner side of the second auxiliary diaphragm extension portion is attached to and fixed to an outer side of the fixing ring fixing portion; and a side of the second auxiliary diaphragm extension portion close to the diaphragm abuts against and is fixed to a side of the fixing ring body away from the diaphragm.

7. The speaker as described in claim 6, wherein the elastic member comprises a first fixing arm fixed to the fixing ring body, a second fixing arm fixed to the holder, and an elastic arm connecting the first fixing arm and the second fixing arm; the diaphragm supporting portion is fixed to a side of first fixing arm close to the diaphragm; the second holder fixing portion is provided with a holder hole that penetrates through the second holder fixing portion; and the second fixing arm passes through the holder hole to be fixed to the first holder fixing portion.

8. The speaker as described in claim 7, wherein the diaphragm body comprises a first suspension having a ring shape, a second suspension having a ring shape and a vibrating portion having a ring shape; the first suspension surrounds the second suspension and is spaced apart from the second suspension; and an outer peripheral side of the vibrating portion is fixed to a side of the first suspension close to the second suspension, and an inner peripheral side of the vibrating portion is fixed to a side of the second suspension close to the first suspension;

the diaphragm fixing portion bends and extends from an outer peripheral side of the first suspension; and the holder body is fixed to a side of the vibrating portion close to the magnetic circuit unit.

9. The speaker as described in claim 1, wherein the fixing ring is a metal ring.

10. The speaker as described claim 1, wherein the frame comprises a bottom wall, a first side wall bending and extending from a peripheral side of the bottom wall, and a second side wall stacked to and fixed to an end of the first side wall away from the bottom wall; and the assembly hole is formed in the second side wall; and the magnetic circuit unit is fixed to the bottom wall; and the diaphragm fixing portion and the diaphragm supporting portion are fixed to the second side wall.

* * * * *